United States Patent [19]

Dziura et al.

[11] Patent Number: 4,882,824

[45] Date of Patent: Nov. 28, 1989

[54] APPARATUS FOR INSTALLING SLIDERS ON A GAPPED SLIDE FASTENER CHAIN

[75] Inventors: Walter H. Dziura, Bethlehem; Angelo Fusco, Waterbury, both of Conn.; Parviz Khosravi, Gainesville, Ga.

[73] Assignee: Scovill Fasteners Inc., New York, N.Y.

[21] Appl. No.: 215,386

[22] Filed: Jul. 5, 1988

[51] Int. Cl.[4] ..... B21D 53/67; A44B 19/41

[52] U.S. Cl. ..... 29/33.2; 29/408; 29/768

[58] Field of Search ..... 29/33.2, 34 A, 768, 29/766, 408, 409, 410

[56] References Cited

U.S. PATENT DOCUMENTS

| | | | |
|---|---|---|---|
| 3,530,563 | 9/1970 | Maeda | 29/33.2 |
| 3,714,698 | 2/1973 | Fukuroi | 29/408 |
| 4,131,993 | 1/1979 | Azzara | 29/768 |
| 4,494,293 | 1/1985 | Kawakami | 29/33.2 X |
| 4,520,544 | 6/1985 | Morita et al. | 29/408 |
| 4,625,398 | 12/1986 | Kando | 29/768 |
| 4,631,818 | 12/1986 | Sassa et al. | 29/33.2 X |
| 4,756,079 | 7/1988 | Kando | 29/768 |
| 4,771,522 | 9/1988 | Osaki | 29/33.2 |

FOREIGN PATENT DOCUMENTS

| | | | |
|---|---|---|---|
| 25148 | 3/1981 | European Pat. Off. | 29/768 |
| 2549603 | 12/1977 | Fed. Rep. of Germany | 29/33.2 |
| 1782885 | 11/1979 | Fed. Rep. of Germany | 29/768 |

*Primary Examiner*—William Briggs
*Attorney, Agent, or Firm*—Dallett Hoopes

[57] ABSTRACT

Apparatus grips and pulls zipper chain along from supply to a desired finite length, installing slider on the way. When next gap in chain is detected by a finger which inserts itself into gap and abruptly stops further advance of tape, a cutter closes to cut chain to length. Puller is driven by air cylinder, and back pressure is applied soon after puller starts. This reduces pulling force and eliminates tearing of zipper tape as tape is abruptly stopped.

5 Claims, 3 Drawing Sheets

APPARATUS FOR INSTALLING SLIDERS ON A GAPPED SLIDE FASTENER CHAIN

BACKGROUND OF THE INVENTION

1. Field of the Invention

This invention relates to an apparatus for installing sliders on a gapped slide fastener chain. More specifically, this invention relates to an apparatus which draws the tape from a supply, installs sliders and then cuts the chain to the desired length according to the frequency of gaps in the chain supply. Still more specifically, the invention relates to an apparatus which installs sliders and cuts slider chain and handles the chain automatically, carefully avoiding tearing or otherwise destroying it.

2. Description of the Related Art Including Information Disclosed Under §§1.97–1.99

The prior art includes apparatus for applying sliders to gapped slide fastener chain and then cutting it to a desired length to make individual fly pieces, pocket zippers and the like. An example is shown in U.S. Pat. No. 4,131,993, which issued Jan. 2, 1979 to Anthony Azzara. While this patent does not disclose in detail the measuring and cutting apparatus but is more intent on the handling of the slider chain and the sliders, the apparatus embodying that invention includes means which abruptly stop the advancement of the chain when it reaches the desired zipper length away from the cutter. More accurately, the Azzara apparatus includes a finger which, when activated, ""feels" along the row of zipper teeth as the chain advances and inserts itself up into the gap when the gap arrives at the finger. An air cylinder driver having grip means engaging the leading end of the chain is then abruptly stopped.

Frequently, in the past, because of the force with which the grips pulled the chain, the cloth tapes of the individual stringers have been torn when the finger abruptly stopped the advancement of the chain. For this reason apparatuses of the prior art were provided with stop means so that the metal frame of the machine stopped the grips from pulling farther once the zipper had been drawn to its selected length. The positioning of the stop was a critical matter and was arduously set to coincide with the engagement of the finger in the trailing end of the gap. Even so, tapes were frequently torn during the slidering.

SUMMARY OF THE INVENTION

To avoid the tearing of the zipper tapes as described above, the present invention proposes the idea of applying a back pressure to the air cylinder which pulls the chain along. Under the preferred form of this invention the back pressure is not applied to the air cylinder until the grips have commenced their movement rearward.

As a consequence, it has been found that apparatuses embodying the invention produce at an overall higher production rate than those of the prior art, and because of the provision of the back pressure on the air cylinder, not only do not tear the zipper tapes but also do not require the stop means which has been necessary in the prior art and which has required a time-consuming and arduous adjustment between each run of zippers of different length.

BRIEF DESCRIPTION OF THE DRAWINGS

Other objects of the invention will be apparent from a reading of the following specification and claims, and references to the drawings. In the drawings:

DESCRIPTION OF THE PREFERRED EMBODIMENT

Figure 2:
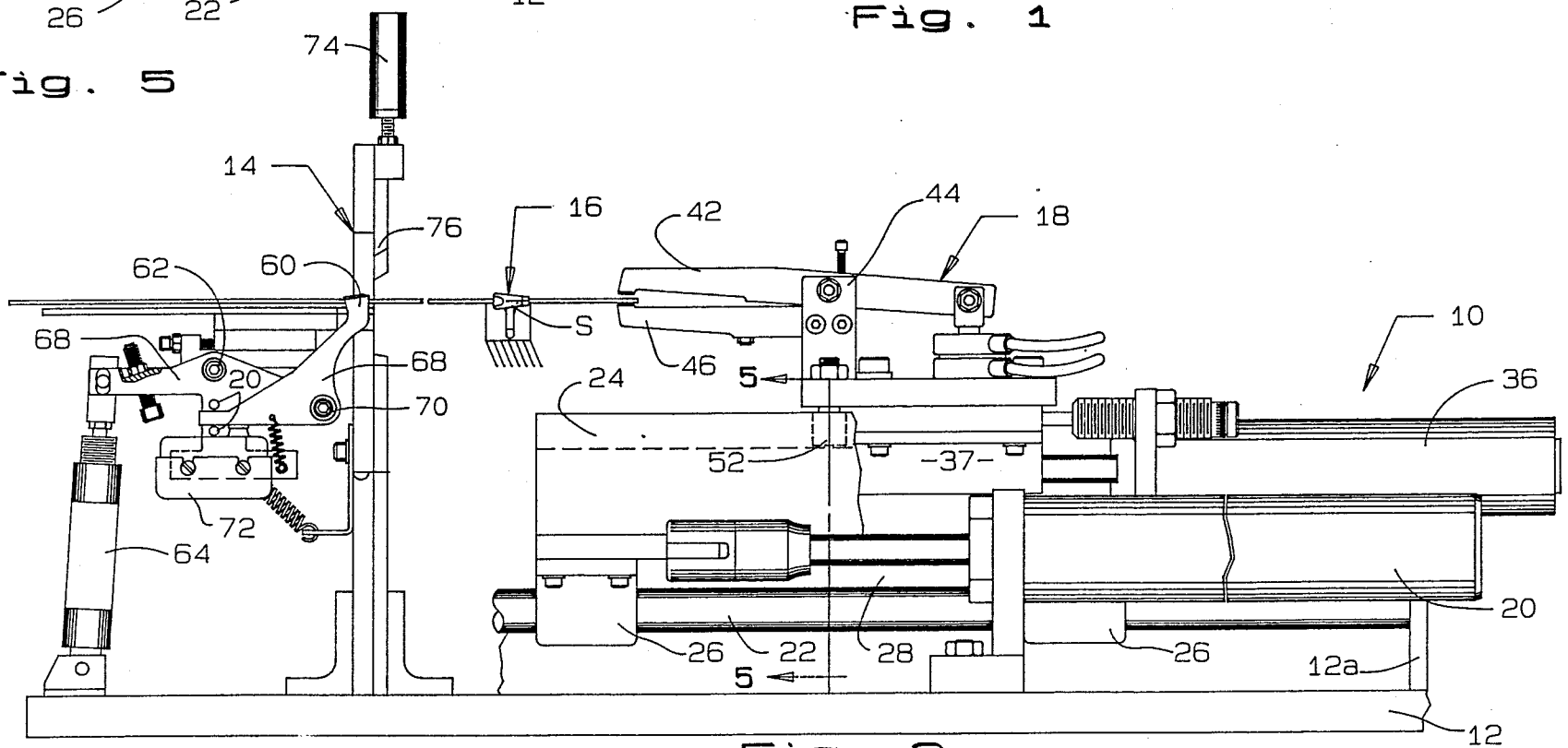
FIG. 2 is a side view of an apparatus embodying the invention showing the platform being partly broken away to disclose the mounting of the grip carriage. Part of the zipper support adjacent the cutter is also broken away to show the operation of the finger.

An apparatus embodying the invention is generally designated 10 in FIG. 2. It comprise a base 12, a finger and cutter assembly 14, a slider supply and holder 16 and a puller or drawer generally designated 18.

Figure 5:
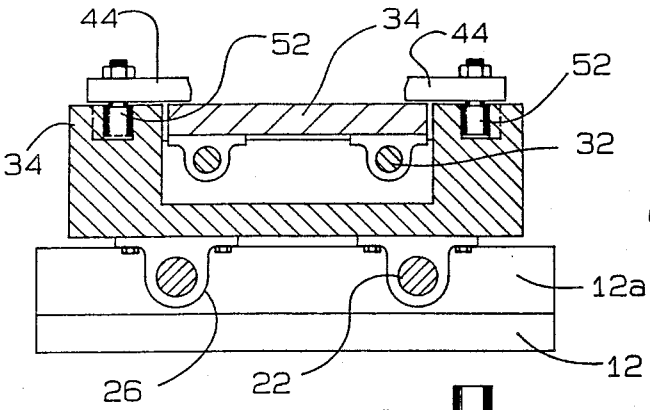
FIG. 5 is a sectional view, slightly reduced and simplified, taken on the line 5—5 of FIG. 2.

The puller or drawer assembly 18 includes a main air cylinder 20 adjustably mounted on the base 12, as shown. Also supported and spaced above the base 12 is a pair of main support rails 22. A U-shaped platform 24 (FIG. 5) has trunions 26 which support it and slide on the main rails 22 supported on upward flanges **12*a*. The connecting rod 28 of the main cylinder 20 has its distal end connected to the platform 24 so that as the piston within the cylinder 20 moves back and forth, it drives the main platform 24**.

Figure 3:
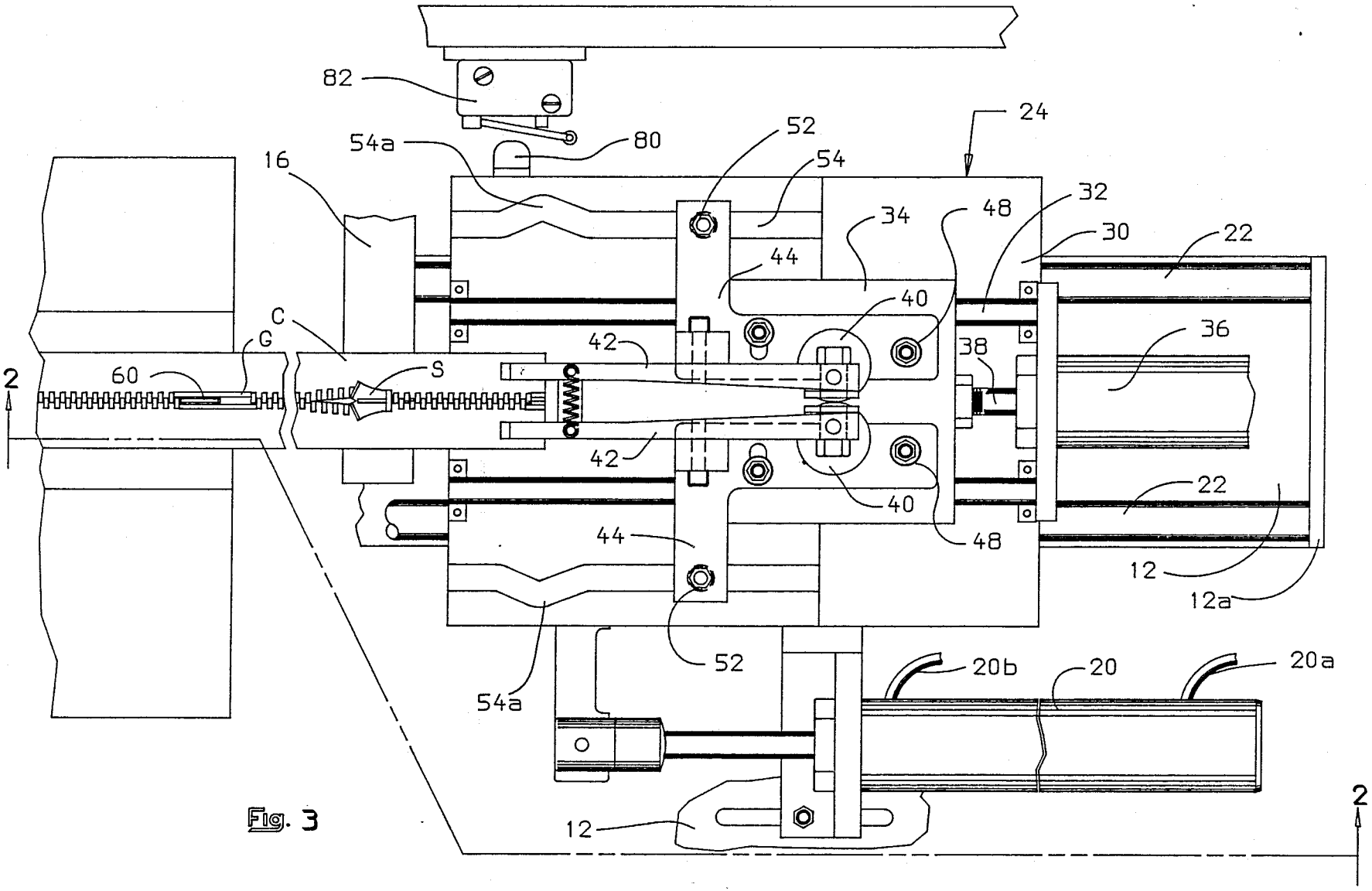
FIG. 3 is an enlarged fragmentary top plan of the apparatus of FIG. 1 and having portions removed for simplicity.

The central floor 30 of the platform 24 mounts parallel carriage support tracks 32, and a grip carriage 34 is mounted by trunions 37 to reciprocate therealong. Carriage drive air cylinder 36 is rigidly mounted on the end of platform 30, and the distal end of its connecting rod 38 is connected to the rightward end of the carriage 34 (FIG. 3).

The carriage 34 mounts a pair of spaced grip-driving air cylinder 40. These cylinders have their drive rods attached to one end of a pair of grip top jaws 42. Centrally each of the grip top jaws 42 is pivoted about a horizontal axis on the upward leg of an L-shaped bracket 44 so that as the grip air cylinders 40 extend, the forward end of the grip top jaws 42 pivots down to clamp against the grip stationary bottom jaws 46.

As shown, the horizontal legs of the brackets 44 are L-shaped and are pivoted to the carriage at 48. The outer ends of the horizontal legs of the brackets 44 are provided with downward cam followers 52 (FIG. 2) which extend respectively down into line cams 54 cut in the upper surface of the U-shaped platform 28.

As shown, the line cams 54 are straight except in area **54*a* wherein they diverge and return. Thus, as the carriage drive air cylinder 36 drives the carriage 34 relative to platform 24, the jaws of the grip units 42, 46 spread apart from each other as they reach the area 54*a* of the line cam 54**. This is for the purpose, as in known in the art, of disengaging the teeth in the front portion of the zipper chain and threading the stringers respectively through the waiting stationary slider S. Once the slider is threaded, the continuing movement of the chain effects the reengagement of the slider teeth behind the slider S.

Figure 1:
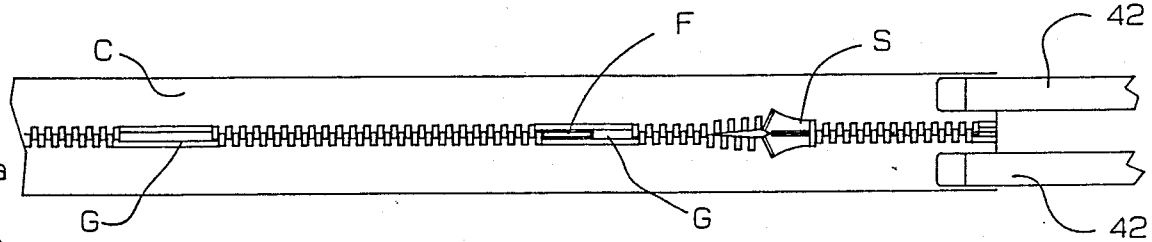
FIG. 1 is an illustrative view of a gapped zipper chain in process showing the leading zipper length being drawn, its slider having been applied and the finger engaging in the trailing end of the zipper gap.

A finger 60 is part of the finger and cutter assembly 14 and is pivoted as at 62 (FIG. 2), being powered upward by the finger air cylinder 64. The finger 60 is actually on a separate lever 66, which is pivoted on the main body 68 as at 70, permitting movement of the finger with respect to arm 68, limited by upper and lower pins 70 on the main body 68. Thus, when the air cylinder 64 lowers, driving the finger 60 upward to "feel" against the bottom of the chain teeth, intrusion of the finger 60 into the next gap G (FIG. 1) and continued pulling of the pulling unit 18 will cause the finger 60 to move rightward (FIG. 2), activating a micro-switch 72 to indicate that the next slide fastener unit is in position for cutting.

In the cutting operation the air cylinder 74 merely drives down the blade 76 to sever the zipper in the gap G.

OPERATION OF THE APPARATUS

Figure 4:
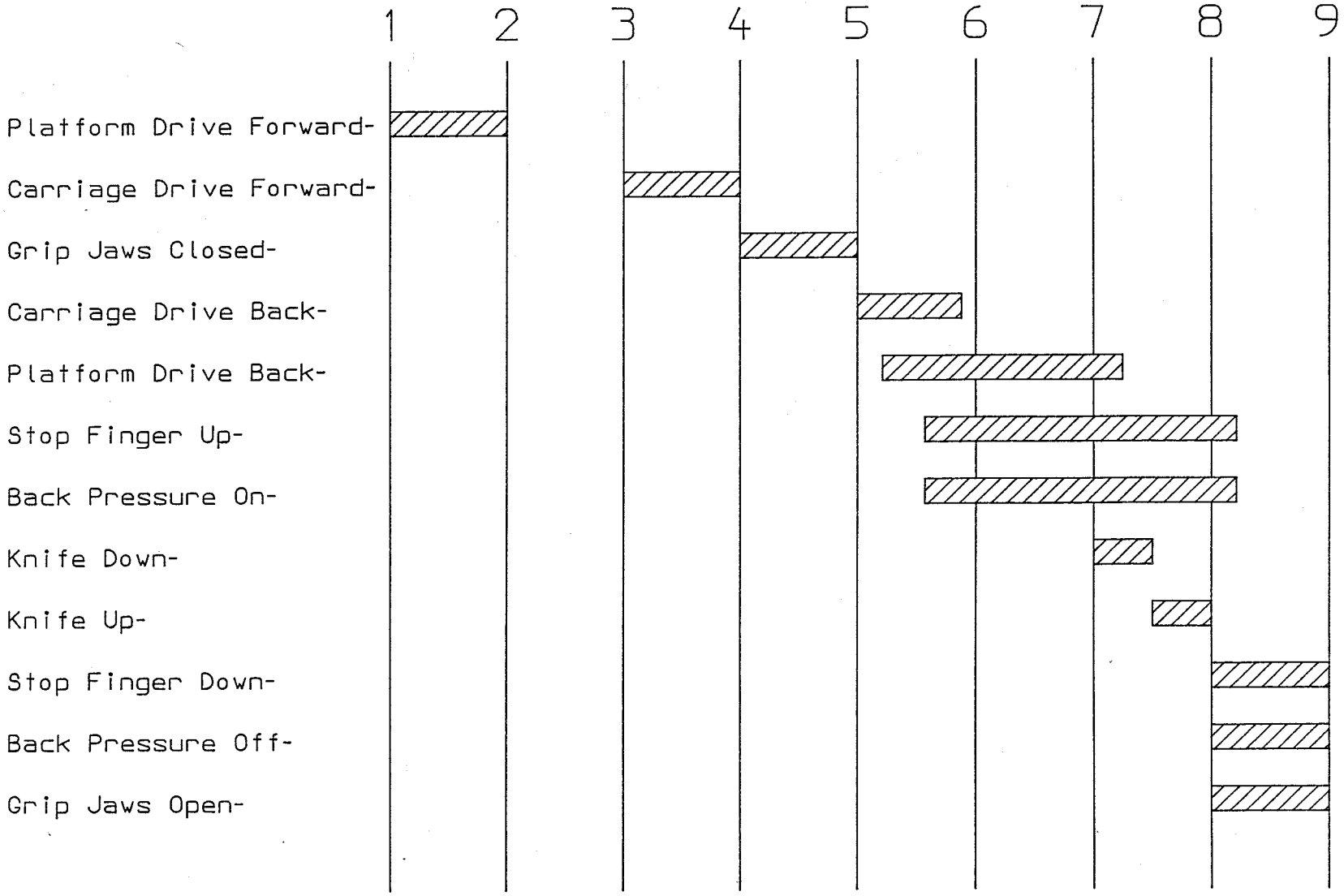
FIG. 4 is a table of sequence of operations of the apparatus embodying the invention.

A sequence-of-operations chart is shown in FIG. 4. The operation starts with the new lead end of the zipper appearing just below the blade 76 after the previous cut-off (FIG. 2). As shown, the main drive 20 is activated, driving the platform with the carriage forward. Shortly thereafter the carriage drive air cylinder 36 (FIG. 3) also goes forward, the grip jaws 42, 46 of both grips being open.

Next, the grip jaws are closed by cylinders 40 so that the front ends of the grips grippingly engage the new lead end of the zipper chain C, the stop finger 60 being retracted by the cylinder 64.

At this point the carriage drive 36 is activated to drive the carriage rearward. It is at this point that the followers 52, engaging in area **54*a* of the line cam 54, spread the grips 42, 46 and introduce the respective tapes to the sides of the waiting slider S. The carriage 34** continues to retreat and in so doing, pulls the chain through the slider for re-engagement, as shown.

When the carriage 34 reaches its rearmost position, it activates through a limit switch (not shown) the main drive air cylinder 20. This commences the rearward movement of the platform 24 along the rails 22, drawing the chain further away from the cutter. At this point a limit trip 80 (FIG. 3) engages the limit switch 82 which activates air cylinder 64 to raise the finger 60, causing it to "feel" along the underside of the zipper chain for the next gap G.

The limit switch 82 also activates a solenoid valve, not shown, to deliver back pressure into the main drive cylinder 20. This serves, as described, to lessen the force with which the carriage 24 is driven. However, the start-up of the platform 24 in the rearward direction has been with the full pressure through the line **20*b* into the rearward drive end of the drive cylinder 20. Illustratively, the full pressure of 80 pounds may be applied at the commencement of the rearward stroke of the cylinder 20 through the line 20*b*. After tripping the limit switch 82, however, a back pressure, illustratively of 60 pounds, may be applied through the line 20*a***.

The platform 24 continues to move rearward until the finger 60 detects the next gap G and inserts itself thereinto (FIG. 3). When the rear end of the gap hits the finger, it abruptly stops the advance of the chain. It also activates the micro-switch 72. Thereafter the cutter 76 is driven down by cylinder 74, severing the chain fastener into the desired length as preset. Subsequently and almost simultaneously, the finger 60 is lowered as the cylinder 64 raises. The back pressure through line **230*a* is cut off and the grip jaws 42, 46** open to drop the new zipper into a waiting receiver.

It should be clear that the mechanism for supplying and holding the sliders S is not disclosed in detail herein, it being disclosed in prior patents.

Because of the selected application of back pressure through line **20*a*, the instantaneous stopping of the advancement of the chain C by the finger does no damage to the leading end of the tapes in the area of grips 42, 46. This distinguishes from the prior apparatus which ruined many zippers as the full rearward pressure was applied to the platform 24 even while the finger 60 stopped the chain. In the present invention at the same time, because full pressure is applied to the cylinder 20** in the initial part of its rearward stroke, the stroke speed of operation of the present apparatus is the same as those without the benefit of the present invention.

While some benefits of the invention can be derived in applying the back pressure to the air cylinder 20 from the commencement of the backward movement of the platform, the foregoing description is the preferred form of the invention.

It should be understood that while the invention is disclosed in only one form, variations, are possible, still enjoying many of the benefits of innovation. Thus, the product afforded may be defined by the following claim language including reasonable equivalents thereof.

What is claimed is:

1. An apparatus for installing sliders on a gapped slide fastener chain drawn from a supply source along a work path comprising:

a. cutting means in the workpath adapted to cut off the chain in the gapped zone to form a new leading end, b. slider clamping means adjusted to clampingly hold sliders one by one in the workpath after the cutting means, c. fastener chain drive means for advancing the chain including a platform mounting two pairs of jaws, the pairs of jaws adapted to close on the new leading ends of the stringers of the chain respectively, spread them and feed them into the wider end of a slider clamped in the clamping means, and advance the slide fastener chain along the workpath, d. a finger disposed on the workpath before the cutting means and when activated adapted to press against the teeth of the chain as the chain advanced and move into the gap in the chain when the gap arrives at the location of the finger, the finger then engaging the trailing end of the gap and arresting the forward movement of the chain and activating the cutting means, e. finger moving means for retracting the finger after the slide fastener has been cut by the cutting means, f. force-reducing means for reducing the force with which the drive means advances the fastener chain, and g. sensing means sensing the arrival of the new leading end of the chain at a given point on the workpath, the sensing means causing the finger to press against the teeth and activating the force-reducing means on the drive means.

2. An apparatus as claimed in claim 1 wherein the platform is moved by an air cylinder.

3. An apparatus as claimed in claim 2 wherein the forcereducing means comprises means to apply back pressure to the air cylinder.

4. An apparatus as claimed in claim 2 wherein a second air cylinder is mounted on the platform to cause the jaws to spread.

5. An apparatus as claimed in claim 3 wherein the finger moving means is an air cylinder.

* * * * *